United States Patent [19]

Gendron

[11] Patent Number: 4,579,277

[45] Date of Patent: Apr. 1, 1986

[54] DETACHABLE TIP-ON ENVELOPE

[75] Inventor: Wilfred H. Gendron, Wilbraham, Mass.

[73] Assignee: Westvaco Corporation, New York, N.Y.

[21] Appl. No.: 717,847

[22] Filed: Mar. 29, 1985

Related U.S. Application Data

[63] Continuation of Ser. No. 459,703, Jan. 21, 1983, abandoned.

[51] Int. Cl.[4] ..... B65D 27/00

[52] U.S. Cl. ..... 229/74; 229/68 R; 229/69

[58] Field of Search ..... 229/68 R, 69, 74

[56] References Cited

U.S. PATENT DOCUMENTS

| | | | |
|---|---|---|---|
| 1,434,097 | 10/1922 | Conner | 229/68 R |
| 2,723,076 | 11/1955 | Whitman | 229/69 |
| 2,824,686 | 2/1958 | Hamilton | 229/69 |
| 3,237,970 | 3/1966 | Mudd, Jr. | 229/69 |
| 3,294,423 | 12/1966 | Mudd, Jr. | 229/69 |
| 3,314,592 | 4/1967 | Streich | 229/74 |
| 3,327,927 | 6/1967 | Allison et al. | 229/69 |
| 3,332,604 | 7/1967 | Whitman | 229/69 |
| 3,369,732 | 2/1968 | Hanson | 229/68 R |
| 3,494,537 | 2/1970 | Gendron | 229/69 |
| 3,580,489 | 5/1971 | Oettinger | 229/74 |
| 3,758,025 | 9/1973 | Schafer | 229/69 |
| 3,790,068 | 2/1974 | Stutz | 229/69 |
| 3,791,572 | 2/1974 | Gendron | 229/69 |

FOREIGN PATENT DOCUMENTS

| | | | |
|---|---|---|---|
| 638355 | 3/1962 | Canada | 229/69 |

*Primary Examiner*—Stephen P. Garbe

[57] ABSTRACT

A first class envelope adapted to be attached to a host piece of second, third or fourth class matter, and useful for sending first class matter at the lower postal rate for the host piece comprises a substantially conventional envelope assembly with a front face and a rear face. The rear face of the envelope is provided with detachable strips formed by perforated lines in the envelope material. The detachable strips are applied with adhesive for attachment of the envelope to its host piece. When the envelope is detached, the only residue that remains on the host piece is the detachable strips from the envelope.

4 Claims, 12 Drawing Figures

DETACHABLE TIP-ON ENVELOPE

This is a continuation of application Ser. No. 459,703 filed Jan. 21, 1983, now abandoned.

BACKGROUND OF INVENTION

Present postal regulations permit the affixing of a first class letter to a package or envelope containing materials mailed by another postal class. For this reason, publishers and other mass mailing organizations are continually seeking new means for attaching envelopes with first class enclosures to lower class publications. These attachments serve two purposes. They permit the inclusion of first class material for the addressee and provide a means for addressing the host material.

Envelopes have been attached to host publications and the like in the past, but in most instances the methods used have been unreliable or unattractive in concept and execution. For instance, the gumming application of some prior envelopes has either been so extensive that the envelope becomes a permanent part of the host piece, or so minimal that the envelope may be inadvertently separated from the host piece. To overcome these difficulties, extra panels have been added to envelopes for the purpose of attaching the envelopes to host pieces. However, this solution incurs extra costs in material and in production which cannot be justified by the advantages of including the first class material with the lower class material. Meanwhile, shipping labels or envelopes currently used on packages, containers and the like, are not appropriate subsitutes because they do not satisfy the postal regulations covering first class material. Accordingly, the present invention was developed to provide a convenient and economical means for including first class material with lower class material mailed at the lower postal rate.

SUMMARY OF INVENTION

The present invention relates to packaging and more particularly to a novel, detachable tip-on envelope for including first class material with material mailed at a lower postal rate. The envelope of the present invention can be mechanically inserted with first class material that is generally mailed separately, and fastened to second, third or fourth class pieces, and mailed at the lower class postage rates in accordance with Postal regulations.

The envelope may be conventionally constructed in one of several different forms from a single blank of material such as paper, and applied with strategically positioned perforated lines to produce detachable strips which remain attached to the host piece when the first class material is removed. In each case, the envelope design is such that only a small amount of residue material remains on the host piece so as not to detract from the appearance of the host piece when the first class material is removed.

In the preferred embodiment, the envelope is prepared in the booklet style with rectangularly shaped elements comprising front and back panels, end closure flaps foldably attached to the front panel, and a top closure flap attached to the front panel. The front panel may include a window and the top closure flap is applied with detachable strips which are aligned with detachable strips of the end closure flaps when the envelope is formed. A modification of this style envelope may include horizontally aligned detachable strips of the back panel and the top closure flap formed by appropriate perforated lines. For this purpose, the perforated lines may be applied along the score lines between the front and rear panels and the front panel and top closure flap, and within the back panel and top closure flap parallel to and slightly spaced from the aforementioned score lines.

Diagonal seam envelopes may also be prepared according to the present invention. For this style, the parallel gummed strips or detachable portions may be formed within the top closure flap and rear panel with perforated lines along the score lines between these elements and the front panel, and within these elements parallel to and slightly spaced therefrom. Meanwhile, vertically aligned gummed strips or detachable portions may be formed in the same style envelopes by applying appropriate perforated lines to the side flaps, rear panel and top closure flap. These perforated lines become aligned with one another at each side when the envelope is formed to provide continuous strips which remain attached to the host piece when the first class material is removed. However, in each case, additional material need be added to the envelope blank, and when it is removed from the host piece, only a small amount of residue material remains which does not detract from the appearance of the host piece.

DETAILED DESCRIPTION

Figure 1:
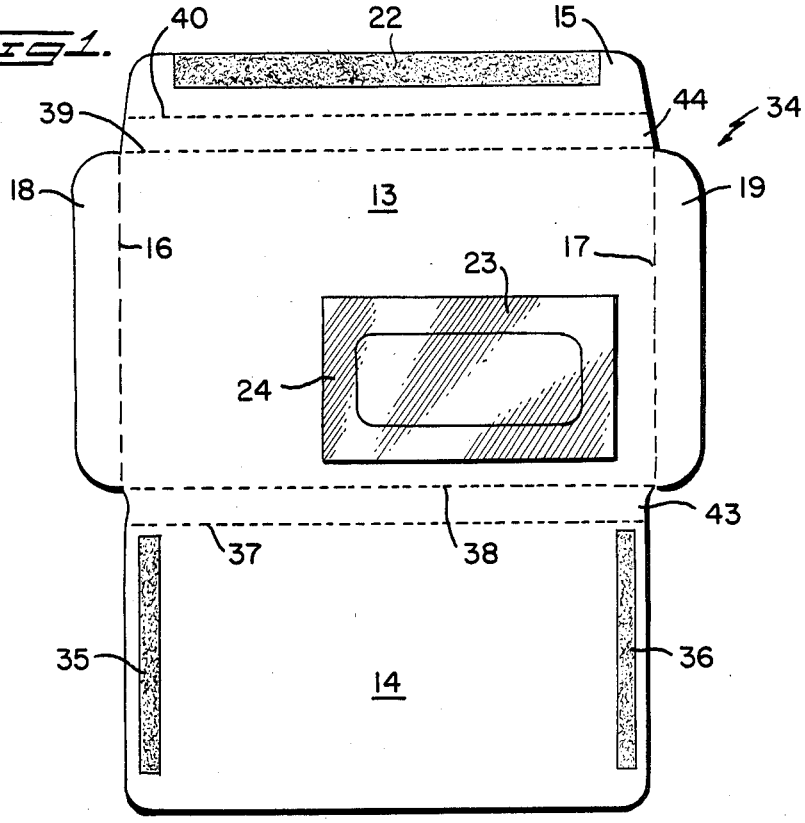
FIG. 1 is a plan view of the envelope according to the present invention.

The drawings illustrate several modifications of the envelope according to the present invention, the envelope attached to the host piece, and the condition of the host piece once the envelope is detached.

FIGS. 1–4 illustrate the present invention as applied to booklet style envelopes. For this purpose, an envelope blank 34 is cut and scored to provide conventional front and rear panels 13,14 a top closure flap 15 and side closure flaps 18 and 19. A strip of adhesive 22 is applied to the closure flap 15 and adhesive strips 35,36 are applied to the rear panel 14 to close the ends of the envelope. However, in this embodiment, the detachable strips 43,44 are disposed horizontally in the envelope structure and are formed by perforated lines 37,38 between the front and rear panels and 39,40 between the front panel and top closure flap. The perforated lines 38,39 are preferably arranged to lie along the fold lines between the front panel 13 and rear panel 14 and the front panel 13 and closure flap 15. Meanwhile, the perforated lines 37,40 are spaced from the fold lines and parallel thereto within the rear panel 14 and the closure flap 15.

Figure 2:
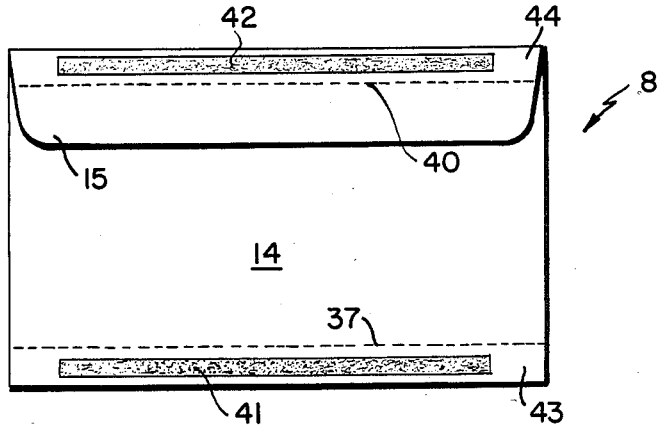
FIG. 2 shows the folded and sealed envelope prepared from the blank of FIG. 1.
Figure 3:
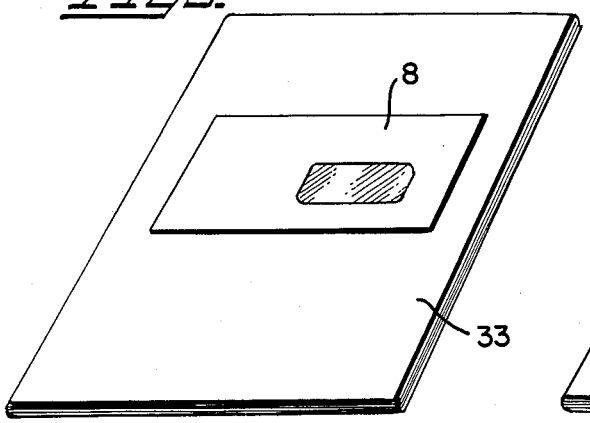
FIG. 3 shows the envelope of FIG. 2 attached to a host piece.
Figure 4:
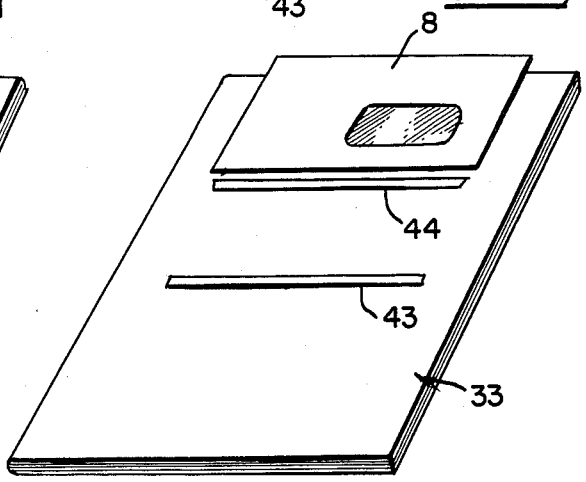
FIG. 4 shows the envelope of FIG. 2 detached from the host piece.

When the envelope is folded and sealed as shown in FIG. 2, the detachable strips 43,44 are applied with strips of adhesive 41,42 which enable the envelope 8 to be attached to its host piece 33 as shown in FIG. 3. When detached, as shown in FIG. 4, the only residue that remains on the host piece 33 is the detachable strips 43,44 of envelope 8.

Figure 5:
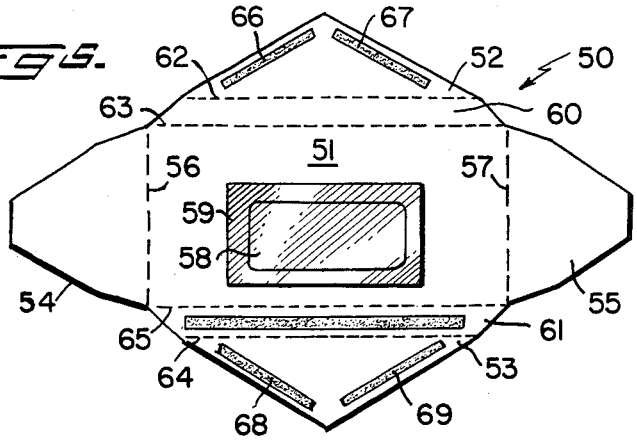
FIG. 5 is a plan view of another embodiment of the envelope according to the present invention.

FIGS. 5–8 illustrate two additional embodiments of the present invention as applied to diagonal seam envelopes. In each case, the detachable strips of the envelope structure are formed from the normal panels used to make the envelope. For this purpose a typical diagonal seam envelope blank 50 as shown in FIG. 5 is cut and scored to provide a front panel 51, top closure flap 52, rear panel 53 and a pair of end closure flaps 54,55 connected to the front panel along scored fold lines 56,57. The envelope front panel 51 includes a window 58 and film overlay 59, and at the top and bottom thereof, a pair of detachable strips 60,61 are formed respectively by perforated lines 62,63 and 64,65. Finally, suitable adhesive patches 66,67 and 68,69 are applied to the top and closure flap 52 and rear panel 53. For convenience, the perforated lines 63,65 are located along the foldable connections between the front panel 51 and the top closure flap 52 and rear panel 53. Obviously these lines could be moved into flap areas as desired.

Figure 6:
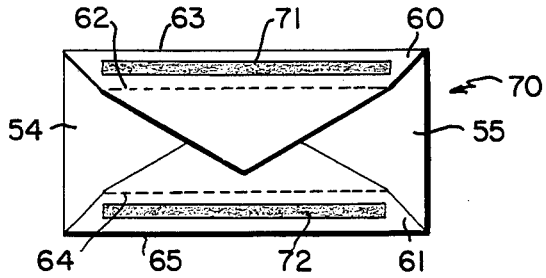
FIG. 6 shows the folded and sealed envelope prepared from the blank of FIG. 5.

When the envelope 70 formed from the blank of FIG. 5 is folded and sealed as shown in FIG. 6, the detachable strips thereof 60,61 are applied with adhesive 71,72 for attachment to a host piece. When the envelope so formed is detached from the host piece as in the embodiment of FIG. 1, the only residue that remains on the host piece is the detachable strips 60,61.

Figure 7:
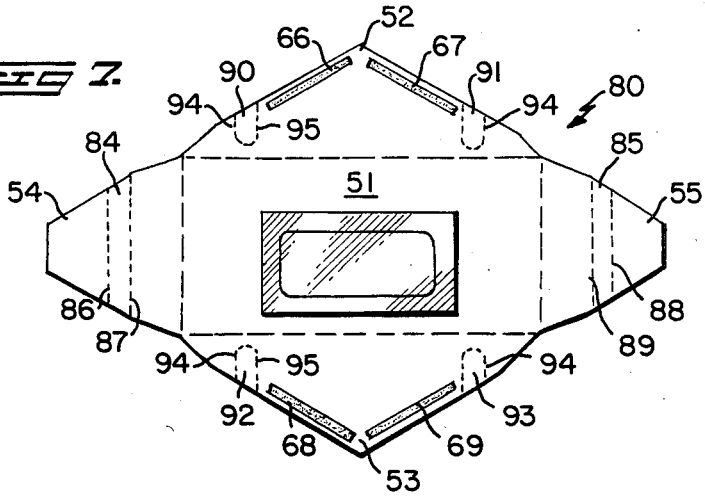
FIG. 7 is a plan view of another embodiment of the envelope according to the present invention.
Figure 8:
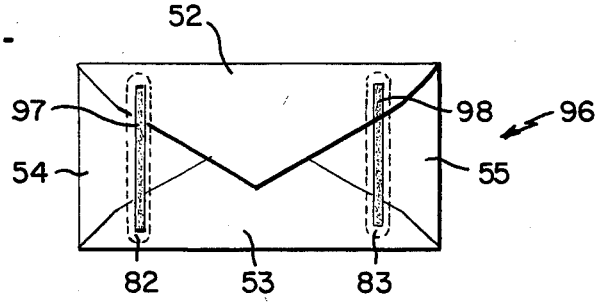
FIG. 8 shows the folded and sealed envelope prepared from the blank of FIG. 7.

The second diagonal seam envelope modification shown in FIGS. 7 and 8 is incorporated in a blank 80. The blank includes a conventional front panel 51, closure flap 52 and rear panel 53 and end closure flaps 54,55. However, the detachable strips 82,83 are vertically oriented and formed by perforated areas in both end closure flaps and both the top and bottom closure flaps. The adhesive areas 66,67 and 68,69 applied to the top closure flap and rear panel are positioned so as not to interfere with the release of the detachable strips 82,83. These portions consist of strips 84,85 found in end closure flaps 54,55 and formed by perforated lines 86,87 and 88,89, and strips 90,91 in top closure flap 52 and strips 92,93 rear panel 53. The latter strips are formed by perforated lines 94,95 at each side of the blank.

As shown in FIG. 8, the various perforated lines become aligned when the envelope is formed to produce the detachable strips 82,83 when the envelope 96 is folded and sealed. Adhesive strips 97,98 are applied to the detachable strips 82,83 for attachment to the host piece. Subsequently, when the envelope is detached, only the detachable strips 82,83 remain on the host piece.

Figure 9:
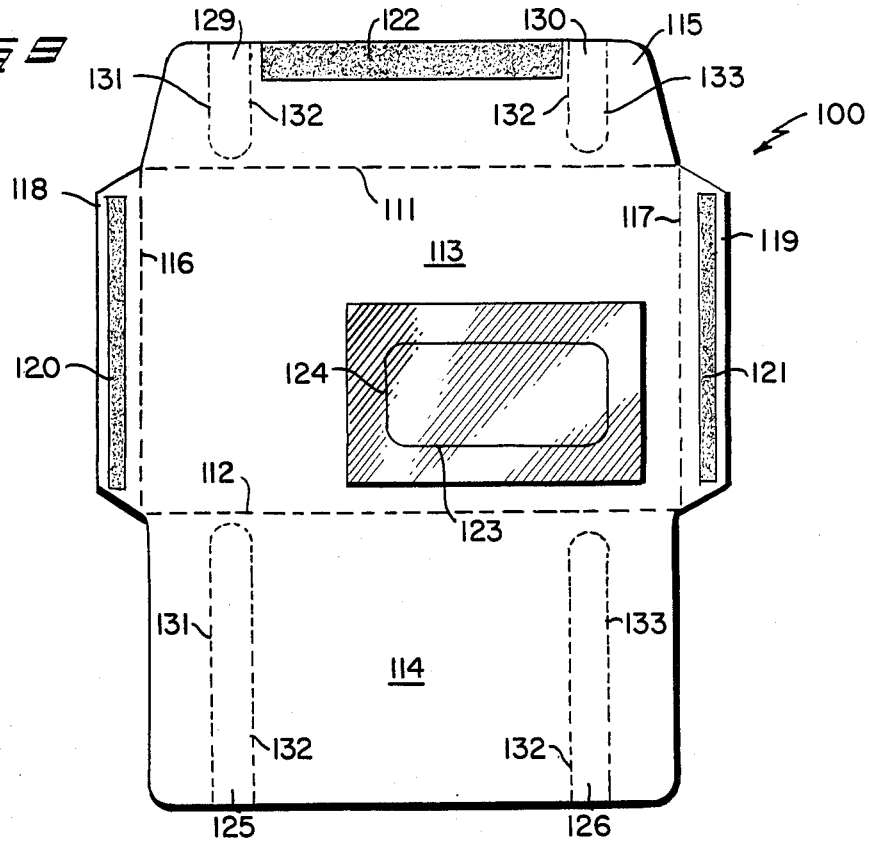
FIG. 9 is a plan view of another embodiment of the envelope according to the present invention.

FIGS. 9–12 illustrate a further modification of the envelope of the present invention as applied to booklet style envelopes. For this purpose the blank structure 100 shown in FIG. 9 is cut and scored to form a front panel 113 between upper and lower score lines 111, and 112, and side score lines 116,117. A rear panel 114 is attached to front panel 113 along score line 112, and a top closure flap 115 is attached to front panel 113 along score line 111. End closure flaps 118 and 119 are foldably attached to the front panel 113 along score lines 116 and 117, and each of the flaps 115,118 and 119 are applied with adhesive patches 120,121 and 122 to close the envelope. Further, as provided in the previous embodiments, the front panel may include a window 123 and film element 124. The detachable strips 125,126 and 129,130 of this embodiment are wholly formed within the conventional panels of the envelope structure by suitable perforated lines 131,132 and 133.

Figure 10:
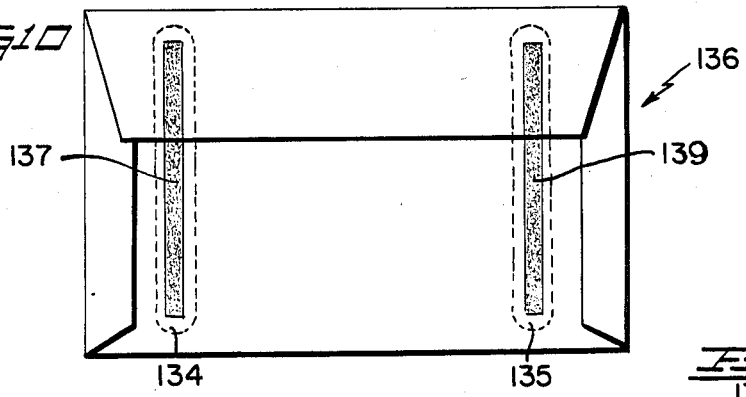
FIG. 10 shows the folded and sealed envelope prepared from the blank of FIG. 9.
Figure 11:
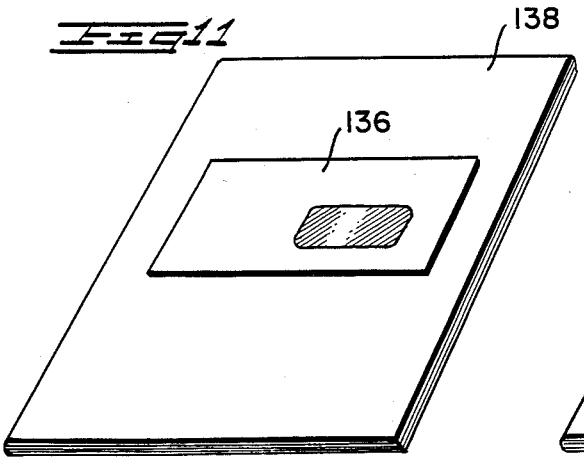
FIG. 11 is a perspective view showing the envelope of FIG. 10 attached to a host piece; and, FIG. 12 shows the envelope of FIG. 10 detached from the host piece.
Figure 12:
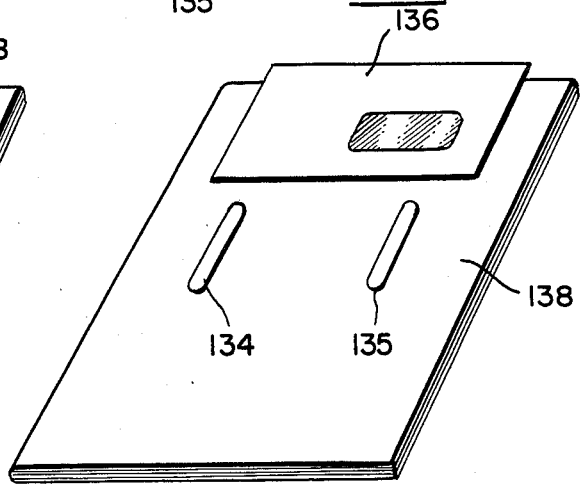

As shown in FIG. 10, the perforated lines in the top closure flap 115 and rear panel 114 become aligned when the envelope 136 is formed and sealed to produce the detachable strips 134,135. Adhesive is applied to these strips at 137,139 and the envelope 136 is attached to a host piece 138 as shown in FIG. 11. When the envelope 136 is detached from host piece 138 as shown in FIG. 12, the only residue that remains on the host piece is the strips 134,135. Accordingly it may be seen that the envelope structure of the present invention is convenient to use and efficient in operation. The envelope may be mechanically inserted with first class material in a conventional manner, sealed and attached to a host piece of second, third or fourth class matter and mailed at the lower postal rate in accordance with Postal regulations. When the envelope is detached from the host piece to retrieve the first class matter, the unique construction of the present invention insures that only a small amount of residue material will remain on the host piece which does not detract from its appearance.

Several embodiments of the present invention have been fully described and illustrated, however, it will be understood that changes in the dimensions and other details of the envelope may be made without departing from the principles of the invention as defined in the appended claims. For instance, the detachable portions formed in the rear of the envelope do not always have to be parallel to one another. Depending upon the style of envelope selected, the detachable strips could be non aligned, converging or at right angles to one another. Also, in selected cases, a single detachable strip might be sufficient to satisfy the requirements of the present invention.

I claim:

1. In combination, a first class envelope and a mailable host piece of another postal class, said envelope being attached to said mailable host piece and mailed together at the postal rate for the mailable host piece, said envelope comprising a plurality of elements including a front panel, rear panel, end closure flaps and a top closure flap, means for attaching the envelope to the exterior of the mailable host piece, said attaching means comprising a pair of spaced apart and parallel detachable strips formed by paired perforated lines located within selected areas of at least two of the envelope elements consisting of the rear panel, top closure flap and end closure flaps, adhesive applied to said strips for attaching the envelope to the mailable host piece for mailing, said strips being detached from the envelope structure when the envelope is separated from the mailable host piece thereby leaving only a small amount of residue material on the host piece when detached.

2. The combination of claim 1 wherein the detachable strips are vertically oriented within the envelope structure and are formed from aligned detachable segments of said rear panel, top closure flap and end closure flaps.

3. The combination of claim 1 wherein the detachable strips are vertically oriented within the envelope structure and are formed from aligned detachable segments of said rear panel and top closure flap.

4. The combination of claim 1 wherein the detachable strips are horizontally oriented within the envelope structure and are formed from detachable segments of said rear panel and top closure flap.

* * * * *